US008516968B2

(12) United States Patent
Pope et al.

(10) Patent No.: US 8,516,968 B2
(45) Date of Patent: Aug. 27, 2013

(54) FLUIDIZED BED

(75) Inventors: LeRoy B. Pope, Post Falls, ID (US); Michael L. Murphy, Coeur d'Alene, ID (US); James M. Scranton, Coeur d'Alene, ID (US); James R. Thomas, Pinehurst, ID (US); Peter Mohr, Hayden, ID (US); Ben H. Cosby, Spokane, WA (US); Michael E. Tracey, Hayden, ID (US); Mark R. Castle, Rathdrum, ID (US); Douglas W. Scrafford, Hayden, ID (US); Greg Dahlstrom, Post Falls, ID (US)

(73) Assignee: Outotec Oyj, Espoo (FI)

( * ) Notice: Subject to any disclaimer, the term of this patent is extended or adjusted under 35 U.S.C. 154(b) by 706 days.

(21) Appl. No.: 12/798,114

(22) Filed: Mar. 29, 2010

(65) Prior Publication Data

US 2011/0232546 A1 Sep. 29, 2011

(51) Int. Cl.
*F23G 5/30* (2006.01)
*F23C 10/20* (2006.01)

(52) U.S. Cl.
USPC ..... 110/245; 110/169; 110/244; 110/243; 110/165 R; 431/159; 432/58

(58) Field of Classification Search
USPC ..... 110/129, 137, 165 R, 167, 168, 170, 110/243, 245, 255, 259, 293, 347; 431/170, 431/328; 34/57 A; 251/298, 299; 294/68.23
See application file for complete search history.

(56) References Cited

U.S. PATENT DOCUMENTS

| | | | | |
|---|---|---|---|---|
| 2,274,001 | A * | 2/1942 | Salenius | 110/167 |
| 3,716,266 | A * | 2/1973 | Garlinghouse | 294/68.24 |
| 4,402,665 | A * | 9/1983 | Korenberg | 431/170 |
| 4,854,854 | A * | 8/1989 | Jonsson | 431/170 |
| 4,885,009 | A * | 12/1989 | Schneider | 95/282 |
| 2010/0116135 | A1 * | 5/2010 | Avina | 95/108 |

FOREIGN PATENT DOCUMENTS

CN 201368647 * 12/2009

* cited by examiner

*Primary Examiner* — Kenneth Rinehart
*Assistant Examiner* — Tiffany Johnson
(74) *Attorney, Agent, or Firm* — Paine Hamblen, LLP

(57) ABSTRACT

A fluidized bed is described and which includes a multiplicity of fluidizing manifolds positioned in spaced relation one relative to the others; an enclosure positioned in gravity receiving relation relative to the multiplicity of fluidizing manifolds and which has an intake and a discharge end, and wherein particulate matter received in the fluidized bed moves under the influence of gravity from the intake end to the discharge end, and a moveable gate is mounted on the second discharge end of the enclosure and which is operable to selectively occlude a discharge aperture and which further facilitates the selective removal of particulate matter and waste material entrained with same, and which moves under the influence of gravity to the discharge end thereof.

18 Claims, 12 Drawing Sheets

FLUIDIZED BED

TECHNICAL FIELD

The present invention relates to a fluidized bed, and more specifically to a fluidized bed which is useful for combusting and/or gasifying various solid and/or liquid waste materials.

BACKGROUND OF THE INVENTION

The operation of various designs of fluidized beds is well understood. As a general matter, fluidized beds are designed so as to suspend solid or liquid fuels on upward blowing jets of air during the combustion process. The result is a turbulent mixing of gas and the waste material. This tumbling action, much like a bubbling fluid, provides more effective chemical reactions and heat transfer. In the past, fluidized bed combustion plants have been used for combusting various types of fuel into energy, and are considered to be more flexible than conventional energy plants in that they can be fired on coal, biomass and other fuels.

In burning solid or liquid fuels in a fluidized bed arrangement, all the combustible components of the fuel are generally converted to heat energy and gaseous byproducts, which mostly consist in the form of carbon dioxide and water. In previous fluidized bed arrangements that have been useful for combusting used-automotive tires, for example, most of the noncombustibles that are left following the combustion and/or gasification process comprise such byproducts as ash which may become entrained within the exhaust gas and removed from the process by the conveyance velocity of the exhausting gases. However, a small portion of the non-combustibles which remain within the fluidized bed are typically in the form of inert material of various sorts. This inert or noncombustible material is typically referred to as "tramp" in the industry. In the case of used, automotive tire derived fuel, this "tramp" may be comprised, at least in part, of the tire bead and/or belting wire used in the construction of the tire which can have a length of 1 to 7 inches depending upon the size of the tire chip that is used as a fuel in the fluidized bed. Of course, these resulting metal wires or beads are not combustible, but in some instances may oxidize, at least in part, to a level which allows some of these inert materials to become airborne, and then be removed by the resulting exhaust gases. The balance of any metal wires, and the like, remain within the fluidized bed environment. Individually, these wires are not detrimental to the combustion or fluidization process, but they tend to accumulate over time, and they further have a tendency to intertwine with one another and create various obstructive random structures or conglomerations. These twisted conglomerations of wires which have often been referred in the industry as "bird nests" may continue to grow in size until they disrupt fluidization and impede the sustained combustion and/or gasification of the automotive tire fuel within the fluidized bed. To prevent this disruptive event from occurring, these intertwined "bird nests" need to be eliminated from the fluidized bed. Inasmuch as automotive tires may contain as much as 10 percent wire or belt content, the accumulation of this type of non-combustible material can occur in a very short period of time and may readily and noticeably impair the operation of the entire fluidized bed.

Heretofore, to address the problem noted, above, operators of such prior art fluidized bed designs had no convenient means available to remove these "bird nests" made of non-combusted wire without first removing a significant portion of the sand from the fluidized bed. As should be understood, prior art fluidized beds have tended to operate in temperature ranges of about 1,200-1,900 degrees F. Consequently, any removal of significant volumes of sand and wire directly from these prior art fluidized bed designs created the potential for significant energy and temperature losses to be experienced in the overall process. Further, handling the sand and other inert material which had entrained "birds nests" within it, of course, creates operational and safety hazards which are readily obvious. Notwithstanding the presence of these several perceived problems, the art has failed to disclose any convenient means so that "birds nests," which have become entrained within the sand of the fluidized bed, can be conveniently removed while not resulting in significant energy losses from the operational fluidized bed environment.

Therefore, a fluidized bed which achieves the benefits to be derived from the aforementioned technology, but which avoids the detriments individually associated with the operation of fluidized bed designs used heretofore is the subject matter of the present invention.

SUMMARY OF THE INVENTION

A first aspect of the present invention relates to a fluidized bed which includes a multiplicity of fluidizing manifolds disposed in predetermined spaced relationship one to the others; particulate matter supported on, and above, the fluidized manifolds and which is further sized to pass between the respective fluidizing manifolds, and wherein during the operation of the fluidized bed a product is combusted in the presence of the particulate matter so as to produce, at least in part, a non-combustible waste material which becomes mixed with the particulate matter; an enclosure having a first intake end located in gravity receiving relationship relative to the multiplicity of fluidizing manifolds, and a second discharge end defining a discharge aperture, and wherein the first intake end of the enclosure receives the particulate matter and any non-combustible waste material which passes between the respective fluidizing manifolds following the combustion of the product which produces the non-combustible waste material; a moveable gate mounted on the second discharge end of the enclosure, and operable for selectively occluding the discharge aperture; and a selectively rotatable engagement assembly mounted within the enclosure and located between the first intake end and the second discharge end, and wherein the selective rotation of the engagement assembly facilitates the substantially uniform movement of the particulate matter and the non-combustible waste material, under the influence of gravity, from the first intake end of the enclosure to the second discharge end thereof.

Still another aspect of the present invention relates to a fluidized bed which includes a multiplicity of fluidizing manifolds positioned in a substantially horizontal orientation and in predetermined spaced relation one relative to the others, and wherein the respective fluidizing manifolds each have a plurality of fluid dispensing nozzles mounted thereon for releasing a source of a fluid which is used, at least in part, to combust or gasify a product, and wherein following the combustion or gasification of the product, a non-combustible waste product is left behind; particulate matter supported on, and above, the fluidizing manifolds and which is sized to pass between the respective fluidizing manifolds, and wherein during the combustion or gasification of the product the resulting waste product becomes mixed with the particulate matter and passes between the respective fluidizing manifolds under the influence of gravity; a frustum-shaped enclosure defined by four sidewalls, and which is positioned in gravity receiving relation relative to the multiplicity of fluidizing manifolds, and wherein the enclosure receives the particulate matter and the non-combustible waste material which passes between the multiplicity of fluidizing manifolds, and wherein the four sidewalls of the enclosure define an internal cavity which has a first intake end which has a first internal cross sectional dimension, and a second, discharge end, which defines a discharge aperture which has a substantially rectangular shape, and a cross sectional dimension which is less than the cross sectional dimension of the internal cavity as measured at the first intake end, and wherein at least two of the four sidewalls of the enclosure are substantially vertically oriented; a selectively rotatable engagement assembly mounted within the internal cavity, and located between the first intake end of the enclosure, and the second discharge end thereof, and wherein the rotation of the engagement assembly has the effect of moving, at least in part, the particulate matter, and any non-combustible waste material substantially laterally so as to facilitate the substantially uniform, vertical movement of the particulate matter, and the non-combustible waste material from the first intake end, to the second discharge end of the enclosure; and a moveable clam-shell shaped gate mounted on the second discharge end of the enclosure and which is operable to selectively occlude the discharge aperture, and wherein the moveable clam-shell shaped gate facilitates the removal of the particulate matter, and any entrained waste material from the enclosure, by way of the discharge aperture, when the clam-shell shaped gate is located in a non-occluding orientation relative to the discharge aperture.

Still further, another aspect of the present invention relates to a fluidized bed which includes a multiplicity of fluidizing manifolds each having an elongated main body having opposite first and second ends, and top and bottom surfaces, and wherein the top surface comprises a pair of angulated surfaces which converge at an apex, and wherein a primary fluid passageway extends from the first end of the elongated main body in the direction of the second end, to the apex of the top surface of the elongated main body; individual fluid dispensing nozzles mounted on the apex of the top surface of the elongated main body and positioned in fluid receiving relation relative to the primary fluid passageway, and wherein the respective fluid dispensing nozzles each have multiple fluid releasing apertures formed therein, and wherein at least some of the fluid releasing apertures direct a stream of fluid laterally outwardly relative to the pair of angulated surfaces which form the top surface of the elongated main body; particulate matter supported on, and above the fluidizing manifolds, and which is sized to pass between the respective fluidizing manifolds, and wherein during a combustion of a product in the presence of the particulate matter a resulting non-combustible waste product is produced and subsequently becomes mixed within the particulate matter and passes between the respective fluidizing manifolds under the influence of gravity; a frustum-shaped enclosure defined by four sidewalls, and which is positioned in gravity receiving relation relative to the multiplicity of fluidizing manifolds, and wherein the enclosure receives the particulate matter and the non-combustible waste material which passes between the multiplicity of fluidizing manifolds, and wherein the four sidewalls of the enclosure define an internal cavity, and further has a first intake end which has a first internal cross sectional dimension, and a second, discharge end which defines a discharge aperture which has a rectangular shape and a cross sectional dimension which is less than the cross sectional dimension of the internal cavity as measured at the first intake end, and wherein at least two of the four sidewalls of the enclosure are substantially vertically oriented; a selectively operable motor mounted on the enclosure; an elongated rotatable shaft located within the enclosure and which is substantially horizontally oriented relative thereto, and wherein the rotatable shaft is drivingly coupled to the motor, and wherein a multiplicity of engagement members are mounted on and extend substantially radially, outwardly, from the elongated shaft, and which forcibly engage and drive at least some of the particulate matter and any non-combustible waste material passing thereby substantially laterally so as to facilitate the substantially uniform vertical movement of the particulate matter and the non-combustible waste material from the first intake end to the second discharge end of the enclosure; and a selectively moveable and generally clam-shell shaped gate which substantially selectively sealably occludes the discharge aperture defined by the second discharge end of the enclosure, and wherein the gate is selectively moveable from a first, occluding position relative to the discharge aperture, to a second, displaced and non-occluding position relative to the discharge aperture, and wherein the moveable gate, in the second position, facilitates the removal of the particulate matter and any non-combustible waste material under the influence of gravity from the enclosure.

These and other aspects of the present invention will be described in greater detail hereinafter.

BRIEF DESCRIPTION OF THE DRAWINGS

Preferred embodiments of the invention are described below with reference to the following accompanying drawings.

FIG. 7 is a side elevation view of a fluidizing manifold which finds usefulness in the present invention.

FIG. 8 is a top plan view of a fluidizing manifold which forms a feature of the present invention, and wherein some underlying surfaces are shown in phantom lines to illustrate the structure thereunder.

FIG. 10 is a perspective, side elevation view of the present invention with the fluidizing manifolds removed so as to show the structure thereunder.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
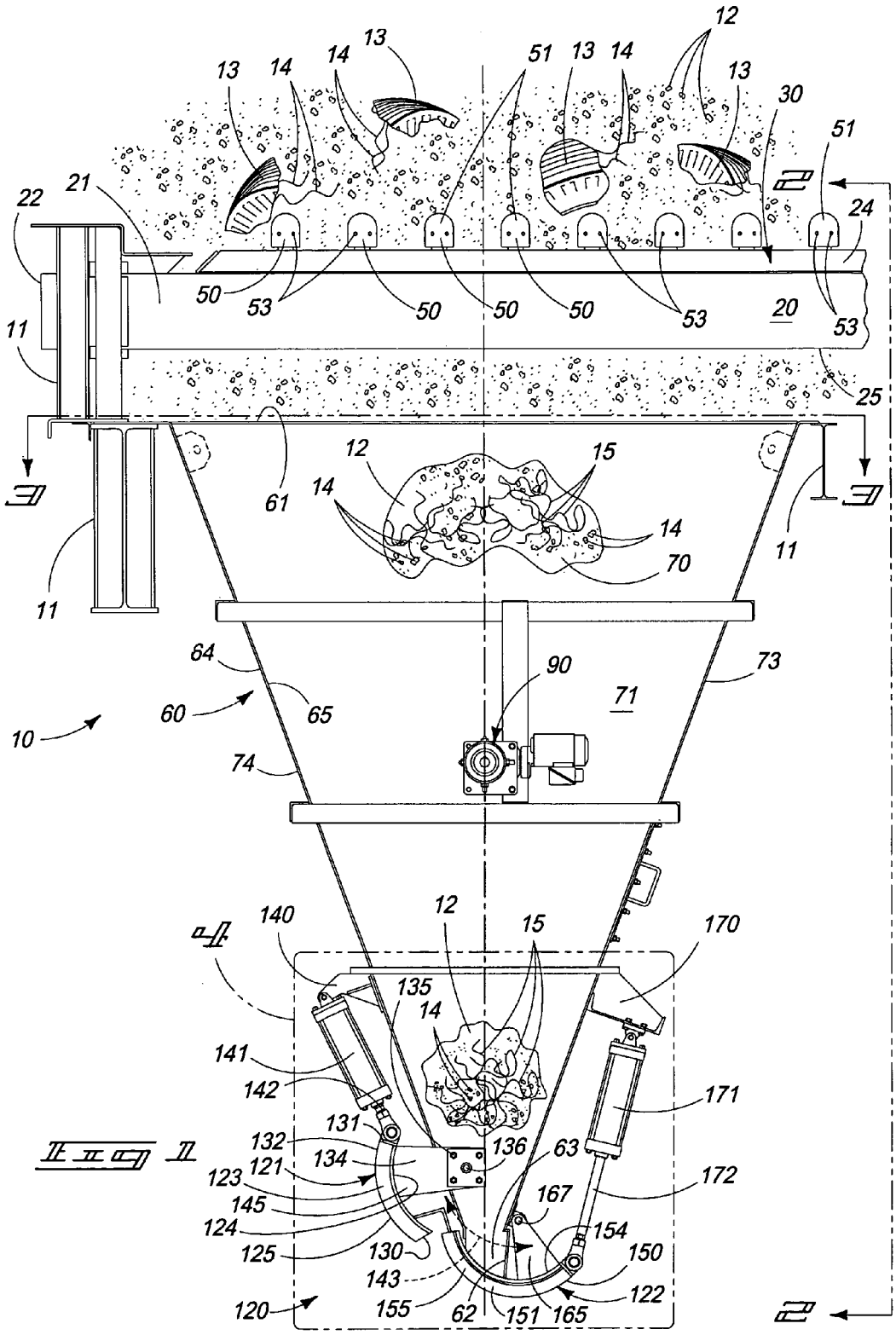
FIG. 1 is a partial, side elevation view of the fluidized bed of the present invention.

The present invention is best understood by a study of FIG. 1. As seen therein, the fluidized bed of the present invention is generally indicated by the numeral 10. It will be understood that the fluidized bed 10 is supported in a given orientation by means of a supporting frame that is generally indicated by the numeral 11. Further, the fluidized bed contains flowable particulate or granular matter which is usually in the nature of sand and which is indicated by the numeral 12. This particulate matter is used during a subsequent, and well known, combustion or gasification process to combust and/or gasify a product (here depicted as automobile tire fragments or pieces) and which is generally indicated by the numeral 13. The combustible product, when processed (combusted and/or gasified) within the fluidized bed, will produce a noncombustible waste product (a tire component) that is generally indicated by the numeral 14. As illustrated in FIG. 1, the combustible product 13 in this one non-limiting example, comprises used automotive tire chips or pieces which may include a noncombustible waste product portion 14 which typically comprises wire or belt cords which were made integral with the automotive tire construction. These materials are, of course, solids. However, the present invention is not limited to the combustion and/or gasification of solids, but may also be used with liquid waste products as well. After the combustion process is completed, the noncombustible waste product portion 14, which may comprise various metal wires and cords, may collect together into a conglomeration which is generally indicated by the numeral 15, and which has been referred heretofore in the industry as a "birds nest". As discussed earlier in this application, such conglomerations of wires, if large enough, can eventually reduce the combustive and/or gasification effectiveness of the fluidized bed 10 if they were allowed to collect in unreasonable numbers or amounts so as to grow larger in relative size.

Figure 2:
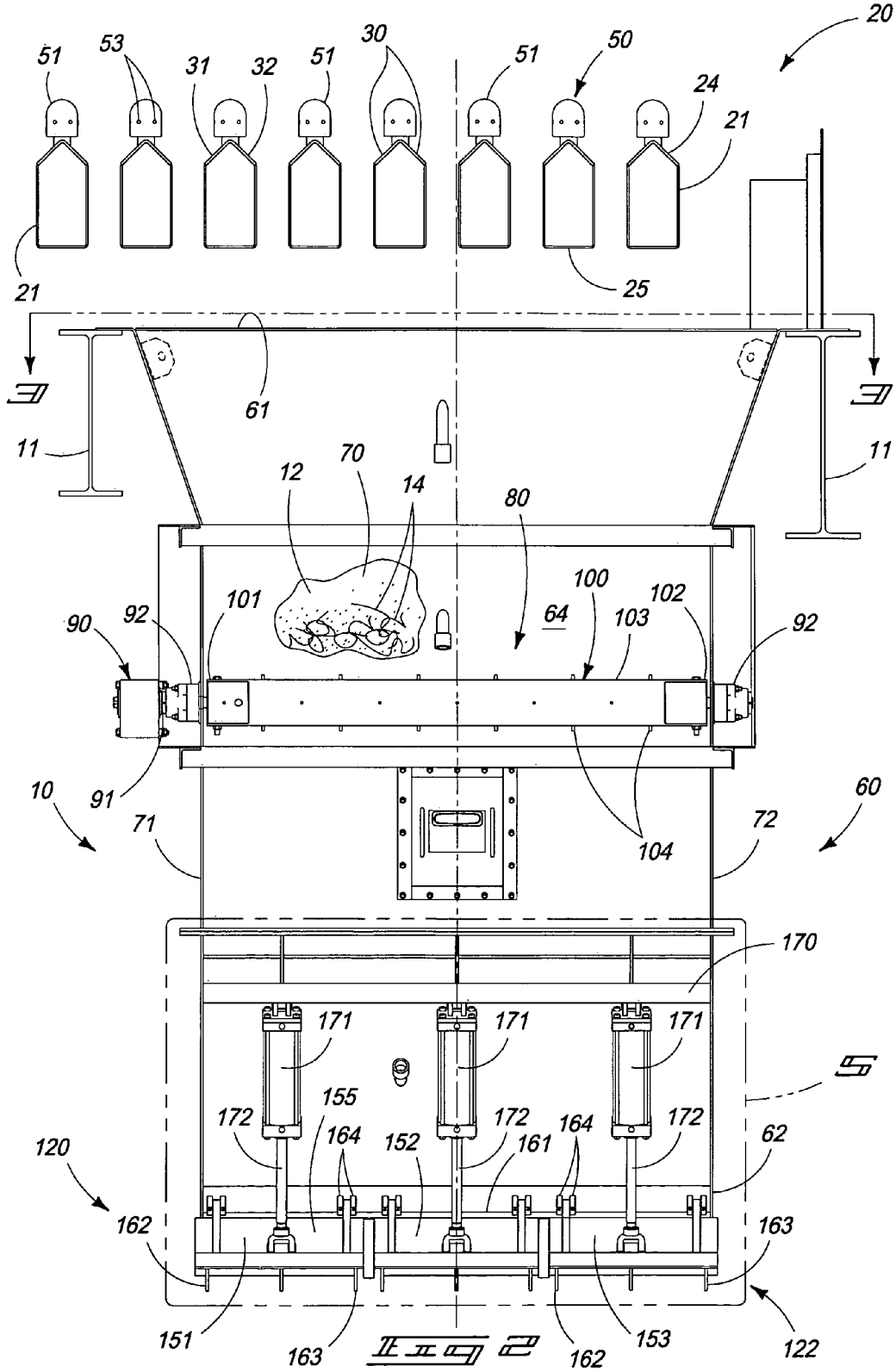
FIG. 2 is a second, side elevation view of the present invention with some supporting surfaces removed to show the structure thereunder, and which is taken from a position along 2-2 of FIG. 1.
Figure 6:
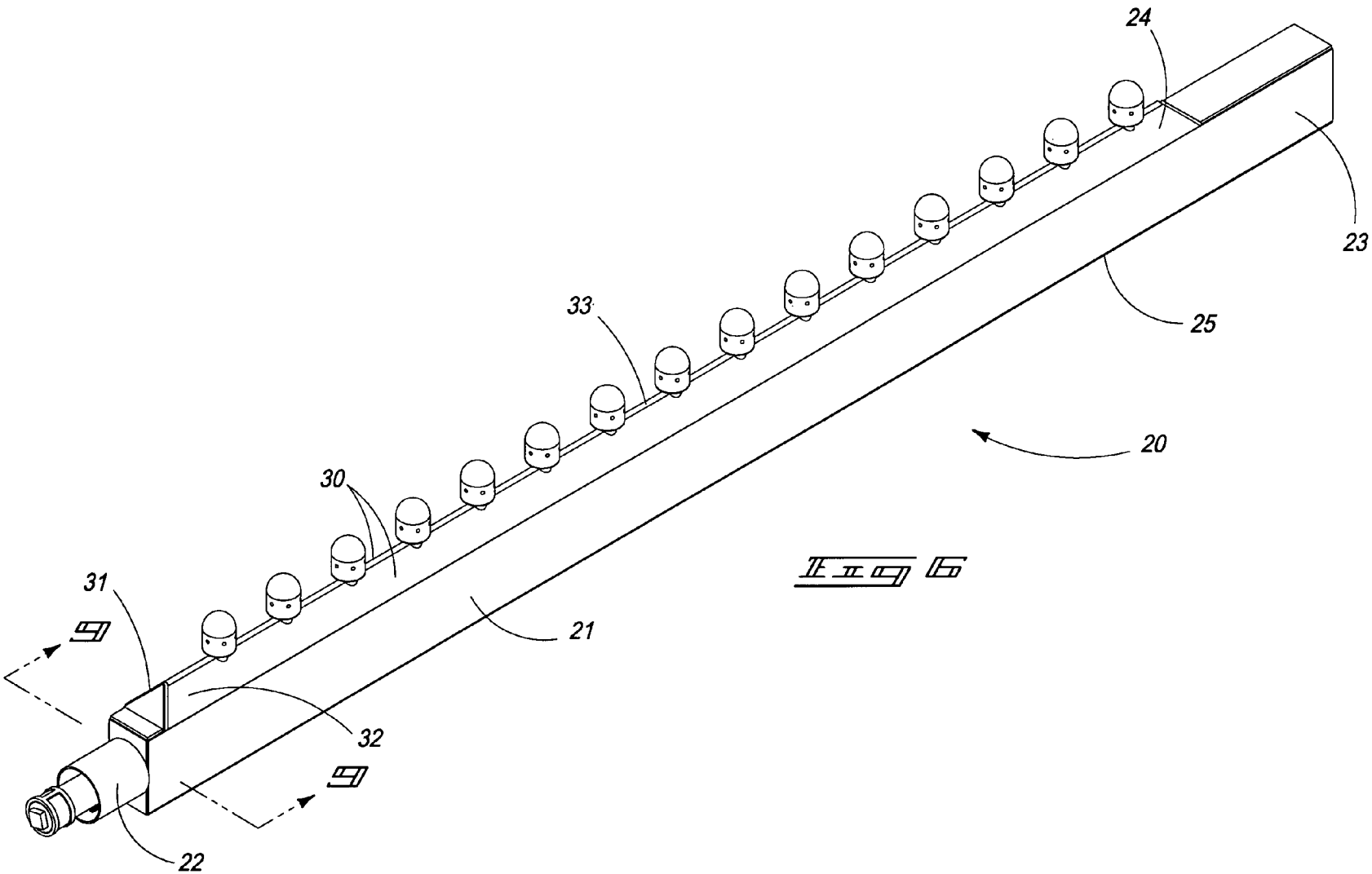
FIG. 6 is a perspective view of a fluidizing manifold which is employed in the present invention.

Referring more specifically to FIGS. 1 and 2 it will be seen that the fluidized bed 10 of the present invention includes a multiplicity of fluidizing manifolds 20 which are disposed in predetermined spaced relationship one to the others. It will be appreciated from a study of FIG. 1 that the particulate matter 12 is supported, at least in part, on and above, the fluidizing manifolds 20. Further, the particulate matter is sized so as to be capable of passing between the respective fluidizing manifolds. During the operation of the fluidized bed 10, a combustible product 13, here illustrated as a portion or a fragment of an automotive tire, is combusted and/or gasified in the presence of the particulate matter 12 so as to produce a noncombustible waste material or product 14 which becomes mixed with the particulate matter 12, as illustrated. The respective fluidizing manifolds, as illustrated in FIGS. 1, 2 and 6, for example, each have an elongated main body 21 having opposite first and second ends 22 and 23, respectively, and top and bottom surfaces 24 and 25, respectively. The top surface 24 includes a pair of angulated surfaces 30. The pair of angulated surfaces include a first surface 31, and a second surface 32. The first and second surfaces 31 and 32 converge at an apex 33. The elongated main body 21 forms or otherwise defines a primary fluid passageway 34 which has a first end 35 located at the first end 22 of the main body and a second end 36 located adjacent to the second end 23 thereof. The primary fluid passageway 34 defined by the main body 21 is operable to receive a source of compressed air (not shown) at the first end 22, and which is utilized to fluidize the particulate matter 12, and the combustible product 13 to achieve advantageous combustion of the combustible product 13 when fuel is introduced to the fluidized bed, so as to produce the noncombustible waste product 14. As seen in FIG. 1, the plurality or multiplicity of fluidizing manifolds 20 are held in predetermined spaced relation, one to the others, by the supporting frame 11. In a commercial embodiment of the present invention, these multiple fluidizing manifolds 20 are fabricated so as to have dimensions which are approximately 10-30 feet long; and about 8 inches wide. Further, these respective fluidized manifolds are spaced some 12 inches, apart, when measured center-to-center.

Coupled in fluid receiving relation relative to the multiplicity of fluidizing manifolds 20 are individual fluid dispensing nozzles which are generally indicated by the numeral 50 (FIGS. 6-9). The respective fluid dispensing nozzles 50 have a main body 51 which defines an internal fluid passageway 52 which is coupled in fluid flowing relation relative to the primary fluid passageway 34 and which is defined by the main body 21 of the fluidizing manifolds 20. The individual fluid dispensing nozzles also define multiple fluid releasing apertures 53 which are coupled in fluid flowing relation relative to the internal fluid passageway 52. As seen in the drawings, the individual fluid dispensing nozzles are mounted on the apex 33 of the top surface 24, and are individually positioned in fluid receiving relation relative to the primary fluid passageways 34. The multiple fluid releasing apertures 53 direct a stream of fluid, typically compressed air, laterally outwardly relative to the pair of angulated surfaces 30 which form the top surface 24 of the elongated main body 21. This stream of fluid (compressed air) generated by the multiple fluid releasing apertures is operable to fluidize the particulate matter 12, and the combustible product 13 to achieve the benefits of the present invention. In the form of the invention as shown above, the respective fluid dispensing nozzles 50 are spaced at a distance of about 12 inches apart. In addition to moving or directing a source of a fluid, such as compressed air or other fluids, laterally outwardly, the respective fluid dispensing nozzles 50 may direct a stream of fluid laterally downwardly onto the top surface 24 of the respective fluidized manifolds 20.

Figure 3:
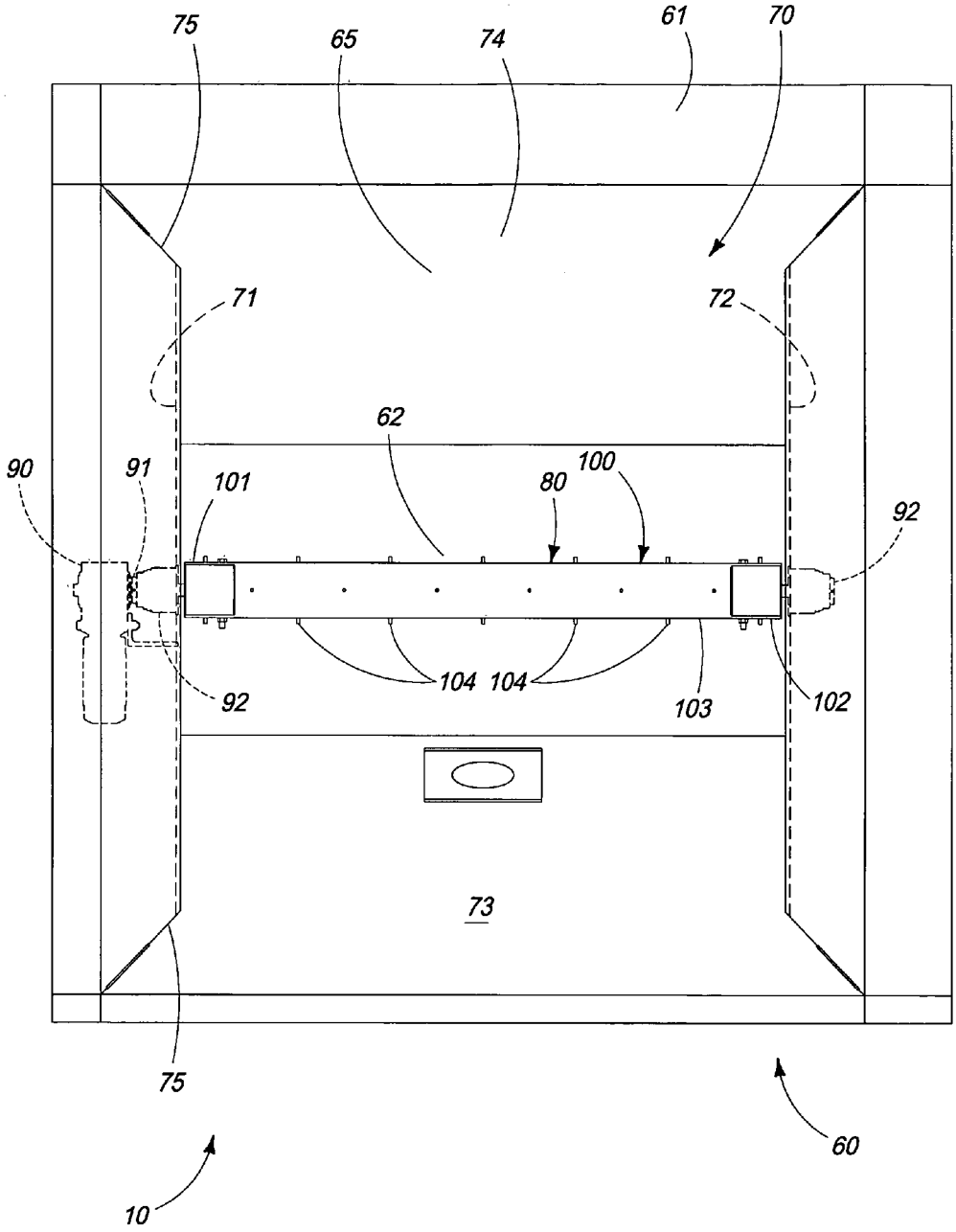
FIG. 3 is a top plan view of the present invention taken from a position along line 3-3 of FIG. 2.

Referring now to FIG. 1, and following, and positioned in gravity receiving relation relative to the respective plurality of fluidizing manifolds 20, is a frustum shaped enclosure which is generally indicated by the numeral 60. The frustum shaped enclosure has a first intake end 61 which has a given cross-sectional dimension, and an opposite, second or discharge end 62, which defines a discharge aperture 63 having a cross-sectional dimension which is less than about 15% of the cross-sectional dimension of the first intake end 61 of the enclosure. The enclosure 60 is defined by an outside facing surface 64, and an opposite inside facing surface 65, which defines an internal cavity 70. The second or discharge end defines a recessed region 66 which matingly receives the leading edge of a moveable gate. This will be discussed in greater detail hereinafter. The internal cavity 70 diminishes in dimension when measured in the direction from the first intake end 61, to the second discharge end 62. The enclosure 60 is formed of first, second, third and fourth sidewalls 71-74, respectively. In the arrangement as seen in the drawings (FIG. 2), the first and second sidewalls 71 and 72 respectively, define a first pair of sidewalls which are substantially vertically oriented, and the third and fourth sidewalls 73 and 74 define a second pair of sidewalls which are nonvertically oriented and which generally converge in the direction of the second discharge end 62 to form the frustum shaped enclosure 60 (FIG. 1). The first, second, third and fourth sidewalls 71-74, respectively meet at internal corners generally indicated by numeral 75 (FIG. 3). The orientation of the respective first, second, third and fourth sidewalls are chosen so as to minimize the amount of particulate matter 12, and noncombustible waste product 14, such as the previously mentioned "bird's nests" which could possibly become deposited within the internal corners 75, and thereby resist gravitational movement or flow from the first intake end 61 to the second discharge end 62 because of the frictional effect of the inside facing surfaces 65 in the region of the corners 75. This will be discussed in greater detail, hereinafter.

Referring now to FIG. 2, the fluidized bed 10 of the present invention includes a selectively operable, and energizeable motor 90 which is mounted on the outside facing surface 64 of the enclosure 60. This motor 90 is positioned intermediate the first intake end 61, and the opposite second end 62. The selectively energizeable motor 90 includes a drive shaft 91 (FIG. 3) which extends through the first sidewall 71 and which is received within a bearing of conventional design, and which is indicated by the numeral 92. The present invention includes an elongated rotatable shaft 100 located within the enclosure 60, and which is substantially horizontally oriented relative thereto. The rotatable shaft 100 is drivingly coupled to the motor 90. Still further, the elongated rotatable shaft has a first end 101, which is drivingly engaged by the motor 90 and is received within the bearing 92; and an opposite, second end 102, which is also supported by another bearing of similar design and which is mounted on the opposite sidewall 72. The elongated shaft has an outside surface 103, and a multiplicity of engagement members or short posts or knobs 104 are mounted on and extend substantially radially outwardly from the elongated rotatable shaft. The respective engagement members forcibly engage and drive at least some of the particulate matter 12, and any noncombustible waste material 14 passing thereby substantially laterally, and generally horizontally, so as to facilitate the substantially uniform downward vertical movement of the particulate matter and noncombustible waste material from the first intake end 61, to the second discharge end of the enclosure 60. The operation of the rotatable shaft has the effect of overcoming the frictional resistance that the inside facing surface 65 of the enclosure 60 has on the particulate matter 12, and any waste products 14 which are entrained therewith. As a result, the particulate matter and waste products can be effectively removed from the enclosure 60.

Figure 4:
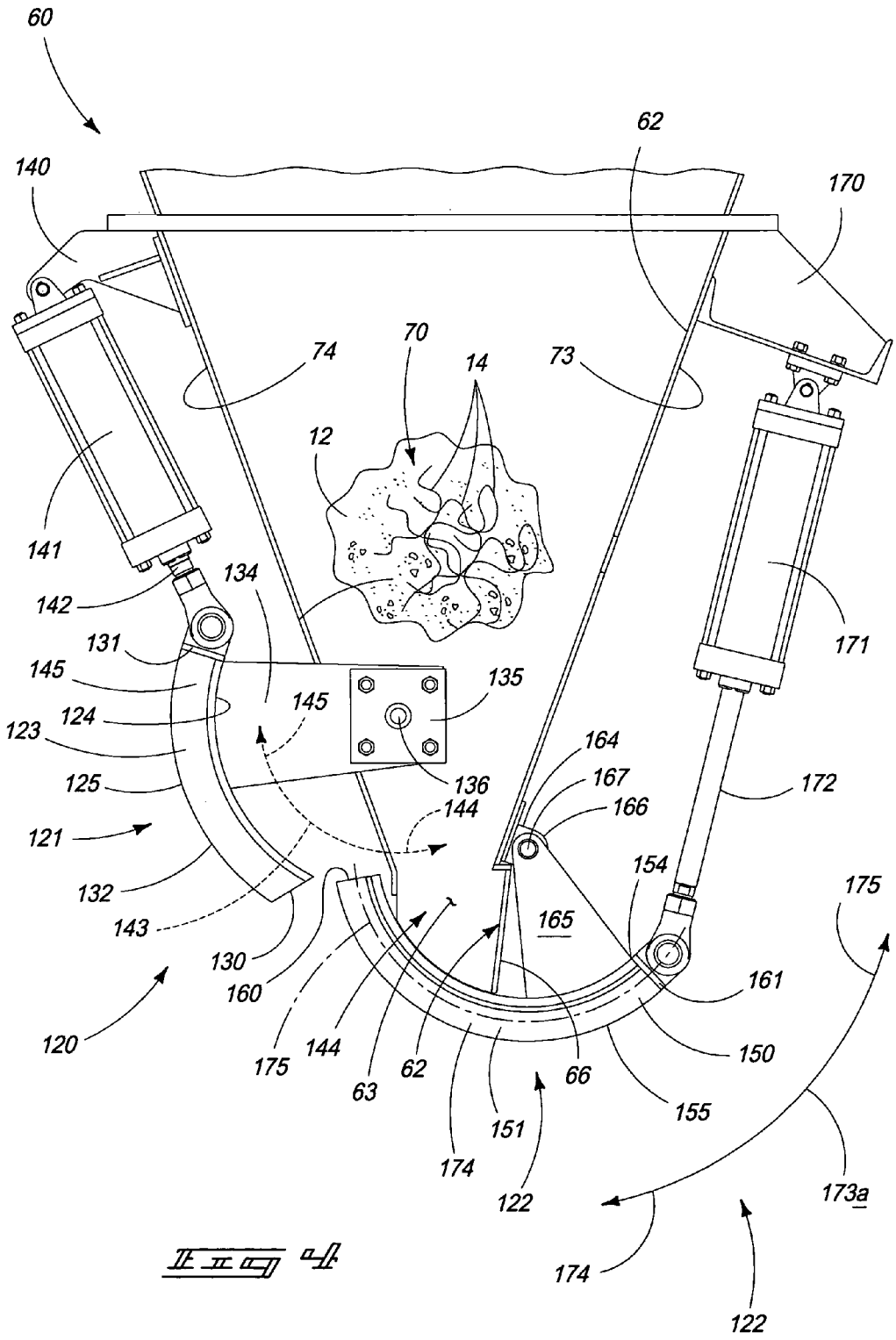
FIGS. 4; 4A; and 4B are a greatly enlarged side elevation views of the present invention and which is taken from a position indicated by the numeral 4 as seen in FIG. 1. These several figures show the various operational positions of the moveable gate as employed in the present invention.
Figure 4A:
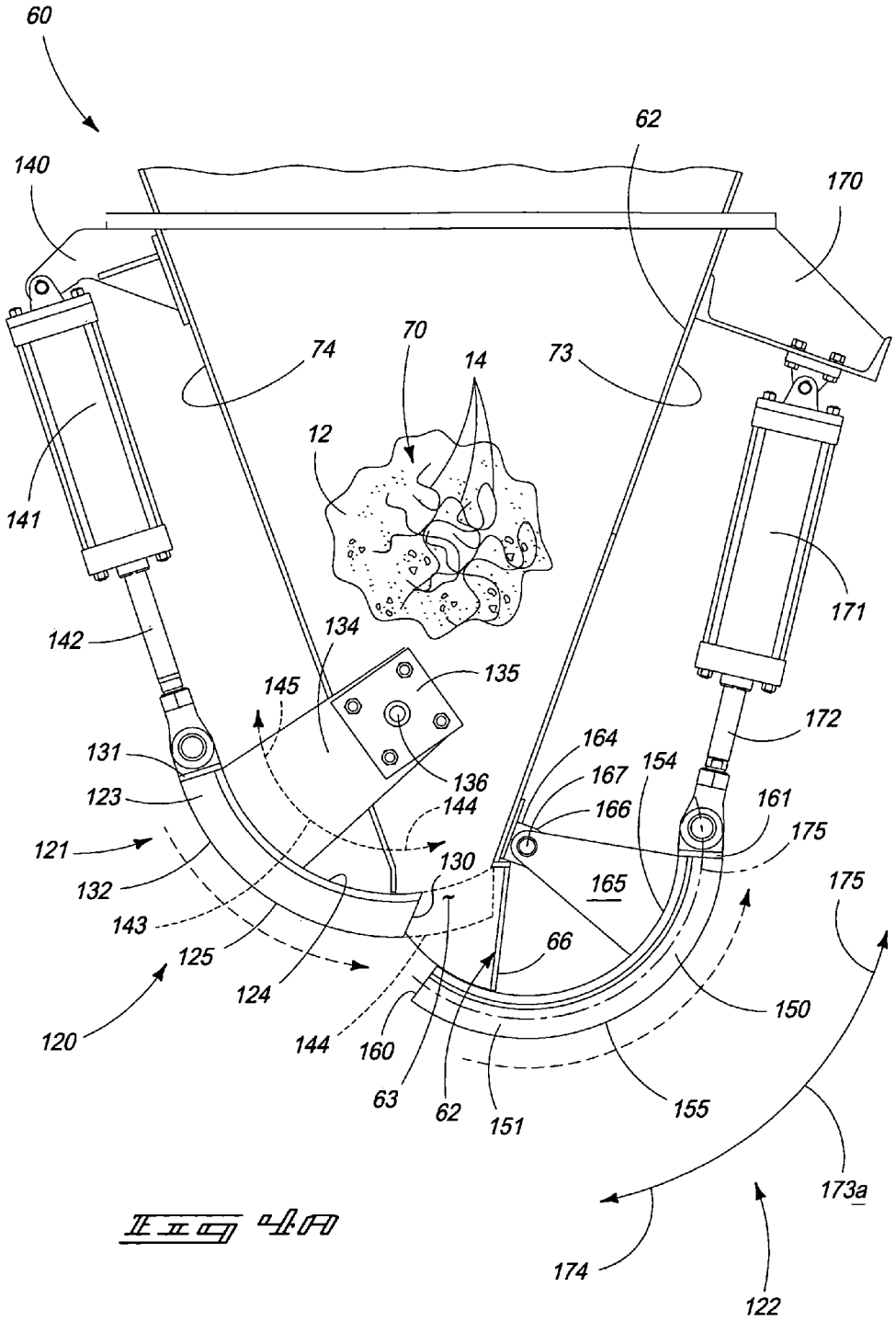
Figure 4B:
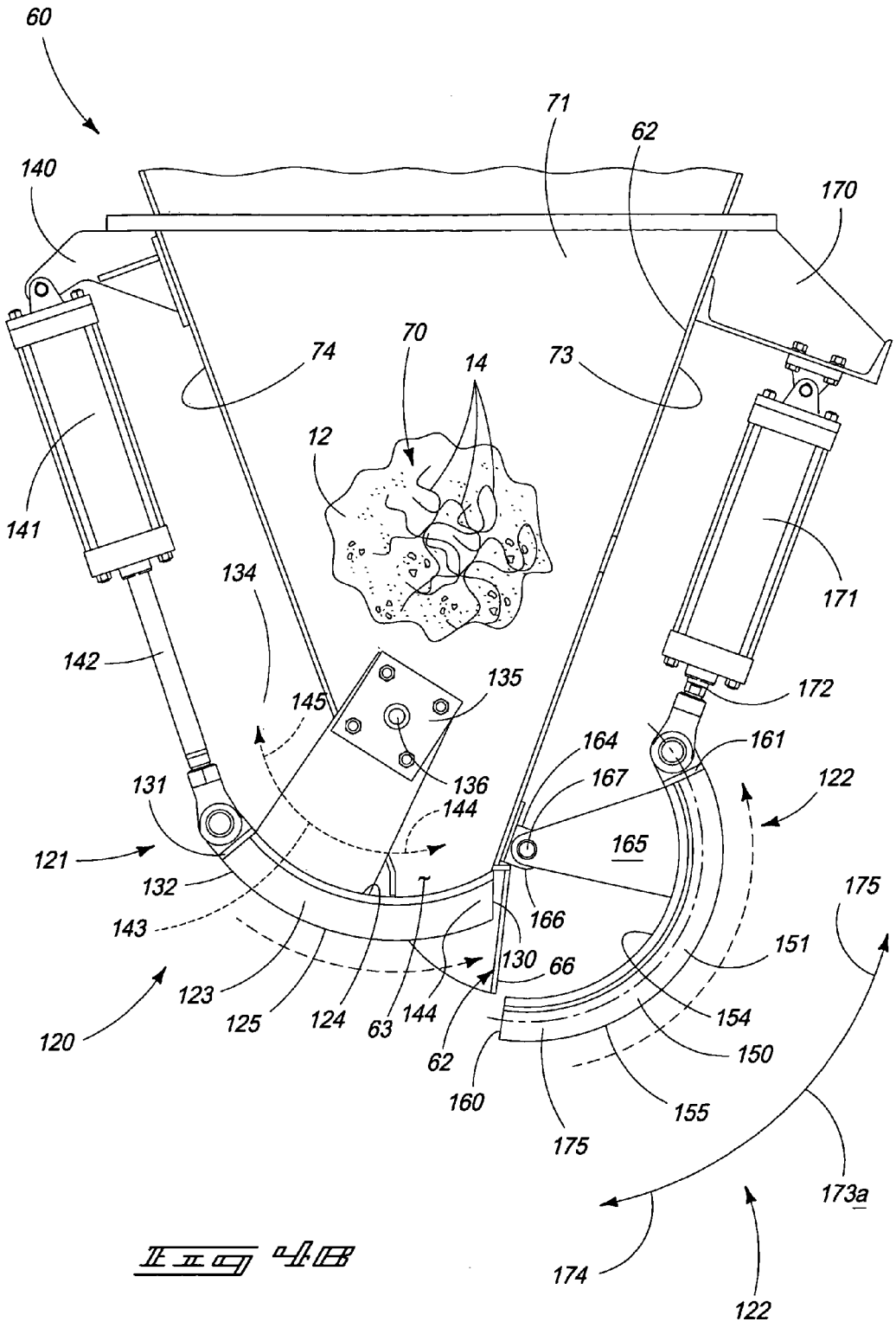
Figure 5:
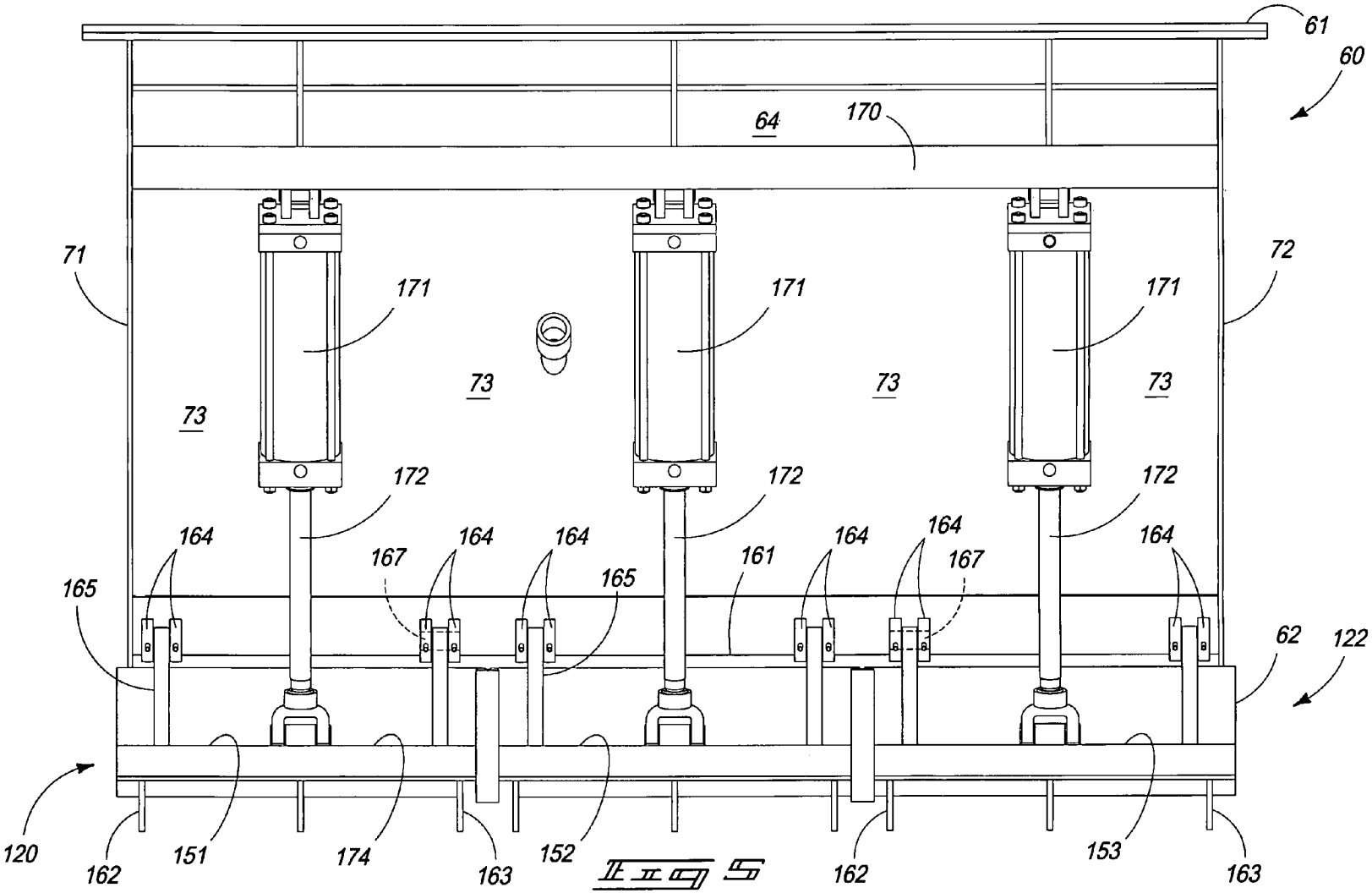
FIG. 5 is a greatly enlarged side elevation view of the present invention which is taken from a position indicated by the numeral 5 as seen in FIG. 2.
Figure 11:
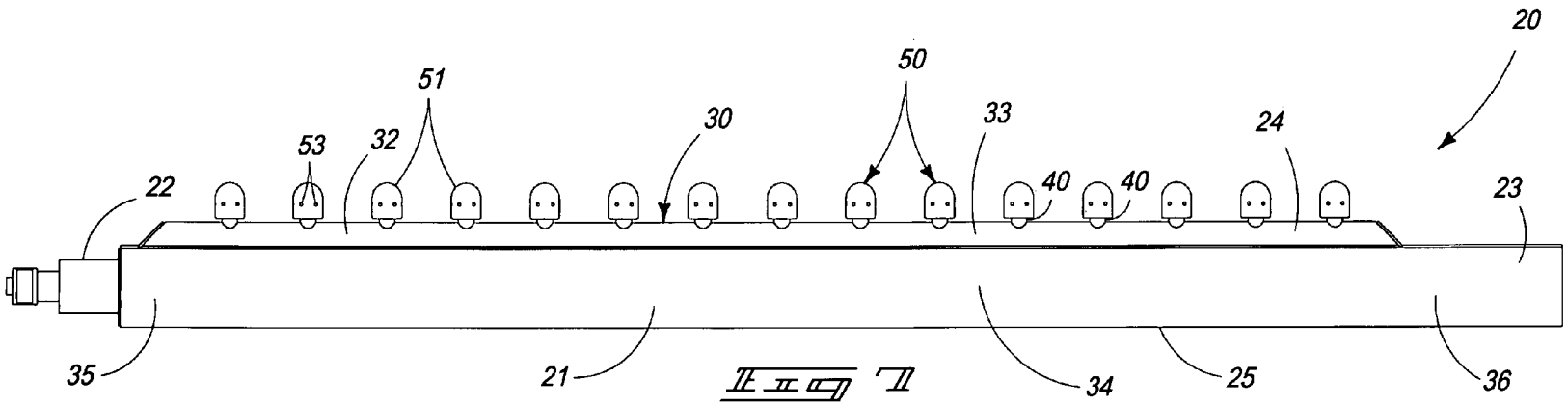
FIG. 11 shows a perspective, side elevation view of the present invention which is taken from a vantage point which is substantially opposite to that seen in FIG. 10.
Figure 12:
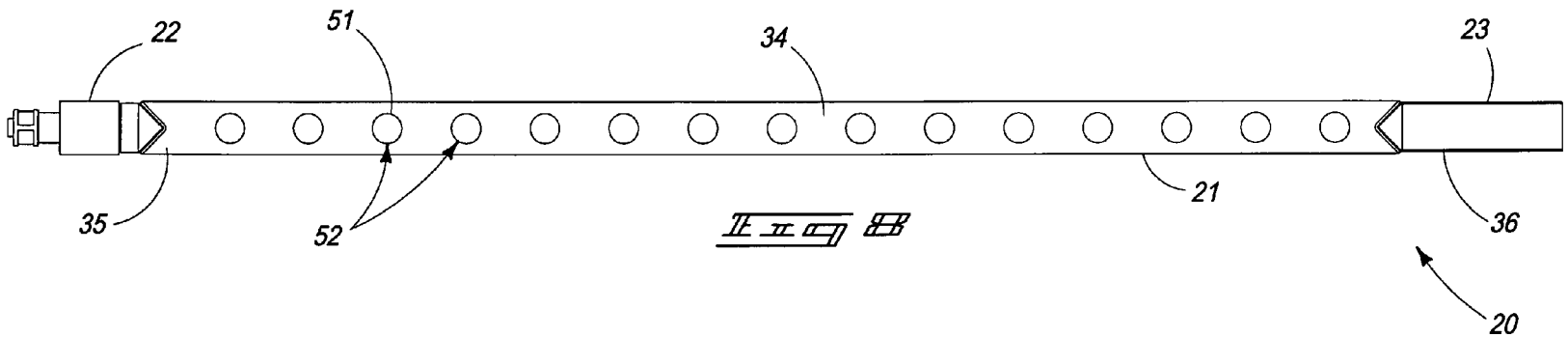
Figure 9:
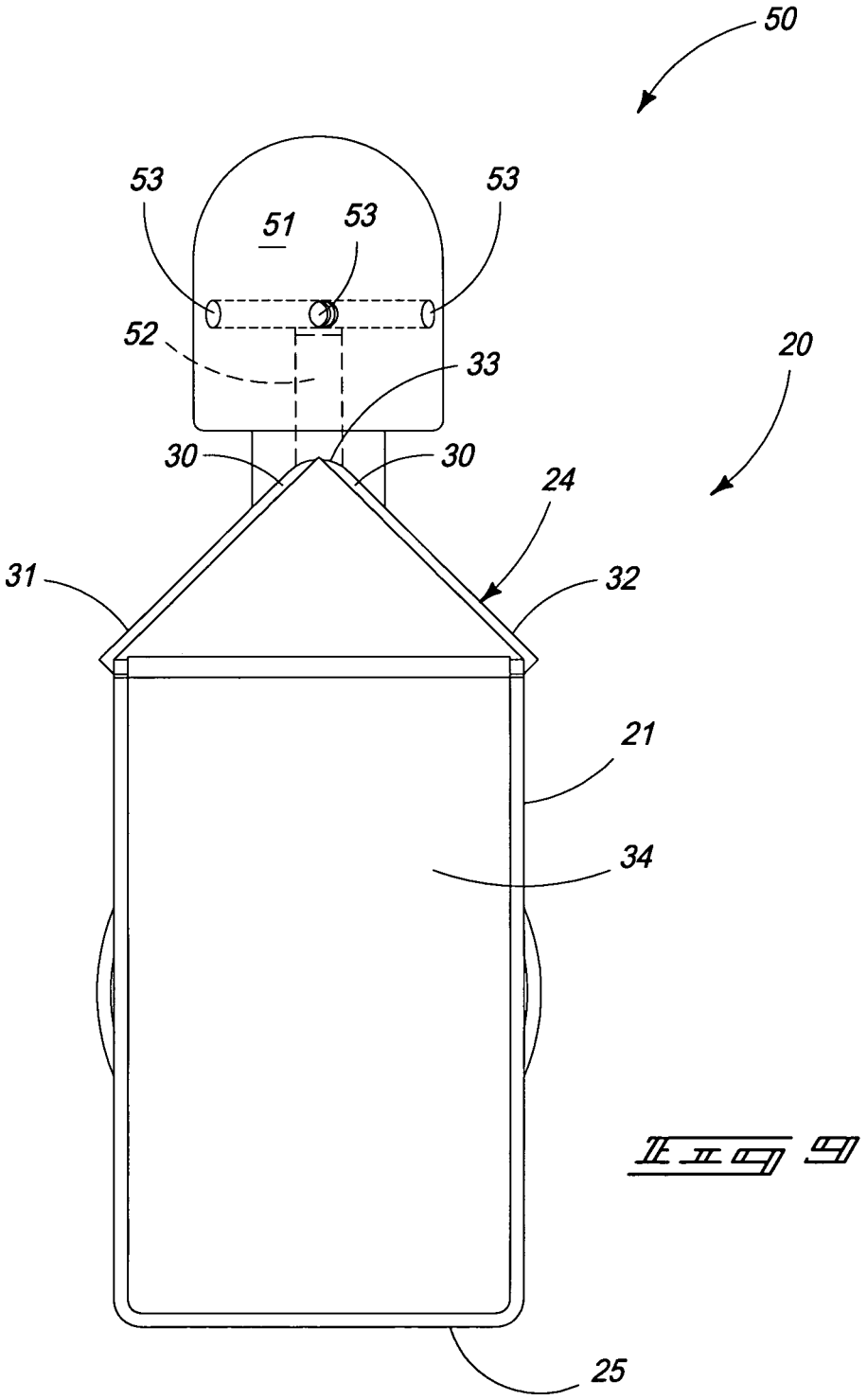
FIG. 9 is a transverse, vertical, sectional view of a fluidizing manifold which is useful in the present invention, and wherein some underlying surfaces are shown in phantom lines to illustrate the structure thereunder.
Figure 11:
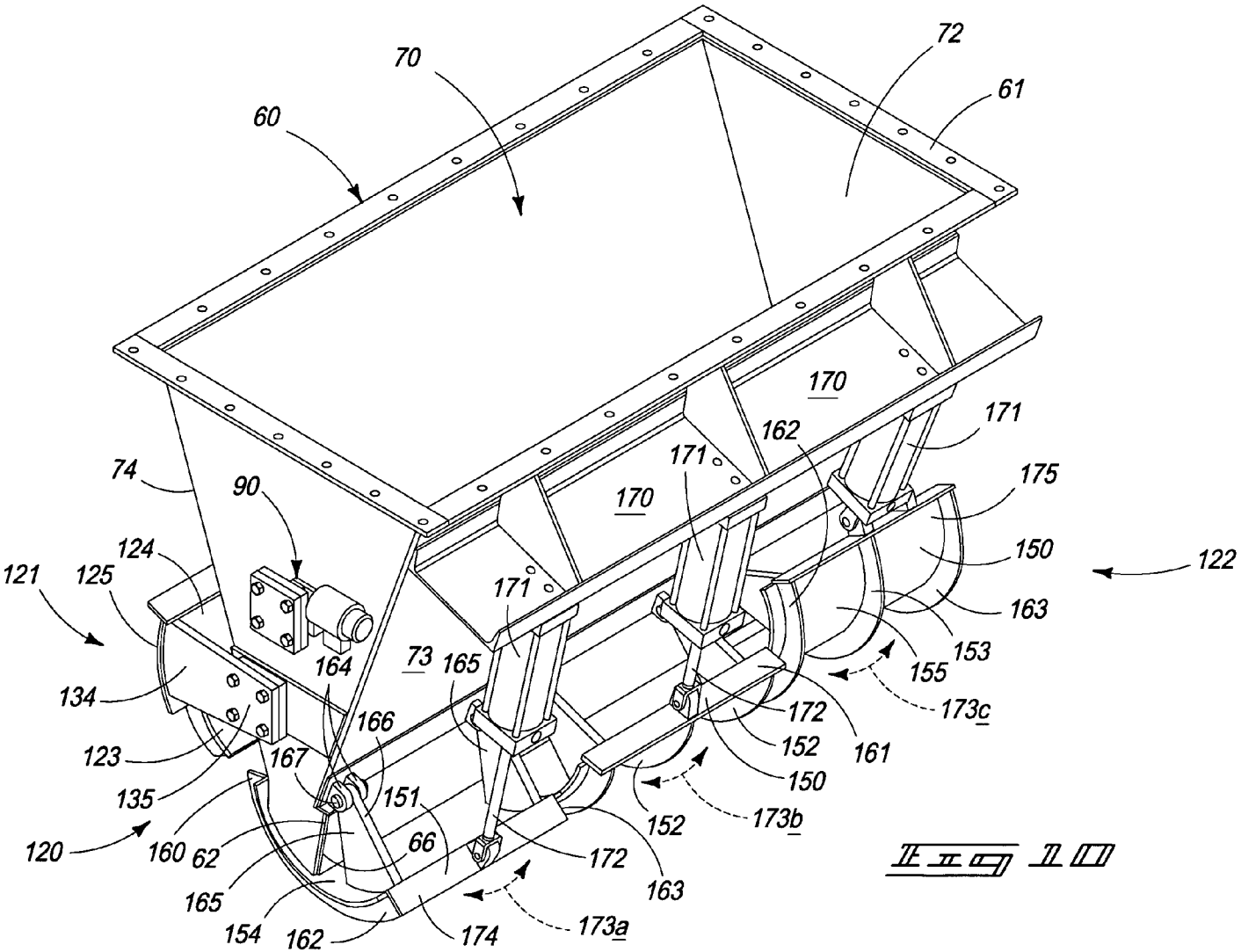
Figure 11:
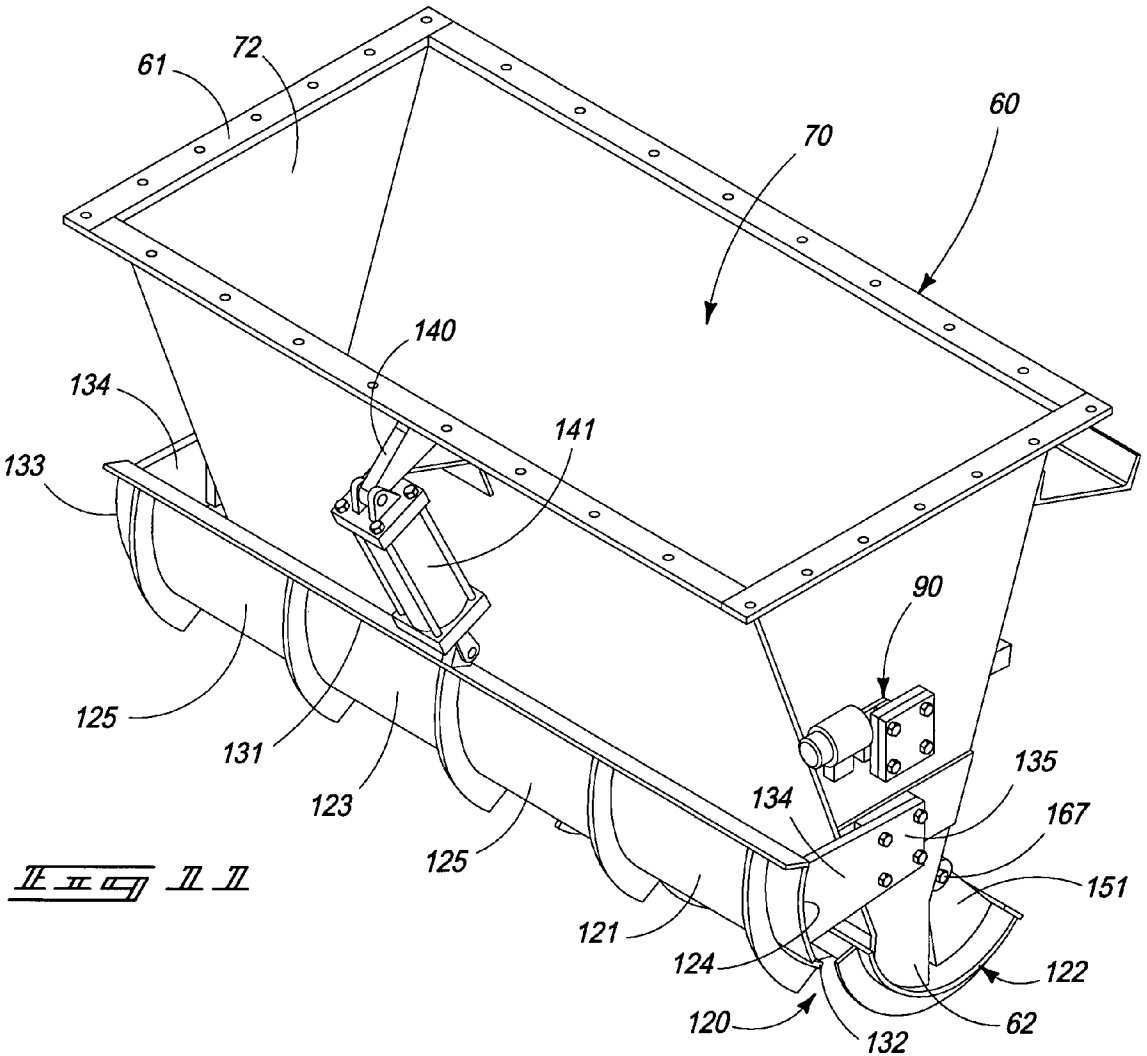

Referring now to FIGS. 1, 2, 4, 10 and 11, the present invention 10 includes a selectively moveable gate assembly which is generally indicated by the numeral 120. In the form of the invention, as shown, the selectively movable gate assembly includes a first generally clam-shell shaped gate 121, and a second multiple-part clam-shell shaped gate 122 which selectively, moveably cooperate together so as to selectively occlude the discharge aperture 63 which is located at the second discharge end 62 of the enclosure 60. It should be understood that the second multiple part gate 122 is the primary or principal means of controlling the removal of the particulate matter 12 and any entrained waste product 14 out of the discharge aperture 63. Further, the first gate 121 is used primarily as a means by which the discharge aperture 63 is occluded so as to allow the inspection and maintenance of the second, multiple part gate 122. By occluding the discharge aperture 63, the selectively moveable gate assembly 120 is operable to retain the particulate matter 12 within the internal cavity 70 of the enclosure 60 against the influence of gravity. Further, by being located in several alternative, selective, non-occluding positions as will be discussed in greater detail hereinafter, an operator of the present invention 10 can remove given amounts of particulate matter 12, and other noncombustible waste products 14 such as the previously mentioned "birds nest's" 15 so as to ensure the efficient and continued operation of the fluidized bed 10. In the arrangement as seen in the drawings, the first clam-shell shaped gate 121 has a main body 123 which is defined by a curved inside facing surface 124, and an outside facing surface 125. As illustrated in FIG. 4, the main body 123 further has a leading edge 130, and a trailing edge 131. As will be recognized from the drawings, the main body 123 of the first clam-shell shaped gate 121 has a length dimension equal to, or slightly greater than the length of the rectangular shaped discharge aperture 63 which is defined by the second discharge end 62 of the enclosure 60. Further, the main body 123 has a first end 132 and an opposite second end 133 (FIG. 11). As illustrated in these views, a support member 134 is secured to the opposite first and second ends 132 and 133, respectively. The support member has a distal end 135 which is pivotally mounted about an axle member 136 which is mounted on the enclosure 60 as seen most clearly by FIG. 4A. Therefore, the support members 134 pivotally support the main body 123 for movement relative to the distal end 62 of the enclosure 60. As seen in the drawings, a pneumatic support member 140 is fixed on the enclosure 60. Further, pivotally affixed to the pneumatic support member is a pneumatic cylinder 141 of conventional design. The pneumatic cylinder includes a moveable ram 142 which is pivotally affixed to the trailing edge 131 of the main body 123. When activated, the pneumatic cylinder causes the ram to move in a fashion whereby the main body 123 is moved along a path of travel 143 from a first occluding position 144 (FIG. 4B) relative to the discharge aperture 63, and into a second non-occluding position 145 as seen in FIG. 4. In a non-occluding position as illustrated in FIG. 4, the first clam-shell shaped gate 121 can be moved as will be discussed hereinafter into a selectively occluding position relative to the discharge aperture 63.

Referring again to FIGS. 1, 2, 4, 5, 10 and 11, it will be seen that the selectably moveable gate assembly 120 includes a second, multiple-part clam-shell shaped gate 122 which cooperates with the first clam-shell gate 121 so as to selectively occlude the discharge aperture 63 when placed in a non-occluding position relative thereto. The cooperative and coordinated movement of the portions of the second clam-shell shaped gates 122, allows the particulate matter 12, and any entrained noncombustible waste product 14, which may take the form of a conglomeration of waste product such as the "bird's nests" to be effectively gravitationally drained and otherwise removed from the cavity 70 of the enclosure 60. As earlier discussed, the process of removing the particulate matter 12 and any entrained waste product 14 is typically done in a coordinated fashion which preserves, to the extent possible, the operational or combustion heat which is generated and present within the fluidized bed 10. In this regard, the second, multiple-part, clam-shell shaped gate 122 includes a main body 150 which is formed of three independently moveable portions or parts here identified as first, second and third portions 151, 152, and 153, respectively. Each of the respective portions 151, 152 and 153 have a curved inside facing surface 154 (FIG. 1), and an outside facing surface 155 (FIG. 4). The main body 150 of the respective first, second and third portions each have a leading edge 160, and a trailing edge 161. Still further, each of the respective portions 151-153 have a first end 162 and an opposite second end 163 which is juxtaposed adjacent to the first end 162 of an adjacent portion. As best seen by reference to FIG. 2, a multiplicity of hinge knuckles 164 are affixed by welding, or the like, on the enclosure 60, and are useful for supporting the respective portions 151-153 for movement along an arcuately shaped path of travel as will be discussed, below. A pair of support members 165 (FIG. 10), are affixed on the opposite first and second ends 162 and 163 of the respective portions 151-153. The support members 165 each have a distal end 166 which is pivotally or hingedly mounted to the respective hinge knuckles 164 using a conventional hinge pin 167. The hinge pin, of course, functions as a pivot point, and allows the respective portions 151-153 to move along a curved path of travel which will be described, below. As seen in the drawings mentioned, above, a pneumatic cylinder support member 170 is affixed to, or made integral with the enclosure 60. Moveably mounted to the pneumatic cylinder support member 170 are a multiplicity of pneumatic cylinders 171 which are spaced apart and which are individually coupled in force transmitting relation relative to the respective portions 151-153. In a manner similar to that which was discussed with respect to the first clam-shell shaped gate 121, the respective pneumatic cylinders 171, when activated, are each operable to move the respective portions 151-153 along individual paths of travel, here indicated by the arrows indicated 173(*a*), 173(*b*) and 173(*c*) (FIG. 10). As will be recognized from this discussion, the portions 151, 152 and 153 can move along these respective paths of travel either in unison or independently of each other so as to allow an operator of the present fluidized bed 10 to selectively occlude the discharge aperture 63 so as to remove only a given amount of particulate matter 12 and entrained noncombustible product 14 from the internal cavity 70 at a given time. As will be recognized, the respective paths of travel 173(*a*), (*b*) and (*c*) each define a path of travel wherein the respective portions, 151, 152 and 153 are moveable between a first occluding position 174 (FIG. 4) relative to the discharge aperture 63 and a second non-occluding position 175 (FIG. 4B) whereby the respective portions are positioned in a non-occluding relation relative to the discharge aperture and allows the particulate matter 12 and the entrained noncombustible waste product 14 to be selectively and controllably removed from the internal cavity 70 under the influence of gravity in a fashion which allows for the convenient and economic operation of the fluidized bed 10.

During the operation of the present invention 10, it will be recognized from the arrangement as described that the first clam-shell shaped gate 121 is located in a non-occluding relation relative to the discharge aperture 63 during normal operational time of the fluidized bed 10. However, as the fluidized bed 10 continues operation and noncombustible waste products begin to collect within the fluidized bed, the operator will activate the respective pneumatic cylinders 171, respectively so as to coordinate the movement of the second clam-shell gate 122 from the first occluding position 174 to the second non-occluding position 174. Simultaneously, with the movement of the first clam-shell gate, the respective pneumatic rams 171 which are coupled to each of the first, second and third portions 151-153 of the second clam-shell shaped gate 122 are moved independently and/or in unison from the second non-occluding position 175 to the first occluding position 174 so as to selectively occlude the discharge aperture 63 of the enclosure 60. This is best seen by studying FIGS. 4; 4A and 4B, respectively. Then, as appropriate, the operator of the fluidized bed 10 would then selectively activate the individual pneumatic cylinders 171 so as to move the respective first, second and third portions 151-153 to selective non-occluding positions 175 relative to the discharge aperture 63 so as to draw down, under the influence of gravity, the particulate matter 12 which has entrained noncombustible waste product 13 within it so as to remove this noncombustible waste product from the internal cavity 70. When these operations are done, the operator will then return the first, second and third portions 151-153 to the first occluding position 174 while maintaining the first clam-shell shaped gate 121 in the second non-occluding position 145 thereby completely occluding the discharge aperture 63. This is best seen by studying FIGS. 4, 4A and 4B. The operator would then provide new particulate matter back into the fluidized bed 10 so as to replace that which has been removed. This is all done in a fashion so as to maintain to the extent possible, the heat of combustion within the fluidized bed 10. The first clam shell shaped gate 121 is placed into the occluding position 144 relative to the discharge end 63 when all three of the second clam shell gates 122 are placed in the non-occluding position 175 for inspection and/or maintenance.

OPERATION

The operation of the described embodiment of the present invention is believed to be readily apparent and is briefly summarized at this point.

In its broadest aspect, the present invention relates to a fluidized bed 10 which includes a multiplicity of fluidizing manifolds 20 which are disposed in predetermined spaced relation one relative to the others. As seen in the drawings, particulate matter 12 is supported on, and above, the fluidizing manifolds 20, and is further sized to pass between the respective fluidizing manifolds 20. During operation of the fluidized bed 10, a product 13 is combusted in the presence of the particulate matter 12 so as to produce, at least in part, a non-combustible waste material 14 which becomes then mixed with the particulate matter 12. The invention 10 also includes an enclosure 60 having a first intake end 61 which is located in gravity receiving relationship relative to the multiplicity of fluidizing manifolds 20, and a second discharge end 62 defining a discharge aperture 63. The first intake end of the enclosure 60 receives the particulate matter 12, and any non-combustible waste material 14 which passes between the respective fluidizing manifolds 20 following the combustion of the product 13 which produces the non-combustible waste material. In the arrangement as seen in the drawings, the invention 10 also includes a moveable gate 120 mounted on the second discharge end 62 of the enclosure 60, and which is operable for selectively occluding the discharge aperture 63. The invention 10 also includes a selectively rotatable engagement assembly 80 mounted within the enclosure 60, and which is located between the first intake end 61, and the second discharge end 62. The selective rotation of the engagement assembly 80 facilitates, at least in part, the substantially uniform movement of the particulate matter 12, and any entrained, non-combustible waste material 14, under the influence of gravity, from the first intake end 61 of the enclosure 60 to the second, discharge end 62 thereof.

Another aspect of the present invention relates to a fluidized bed 10 which includes a multiplicity of fluidizing manifolds 20 which are positioned in a substantially horizontal orientation and in predetermined spaced relation one relative to the others. The respective fluidizing manifolds 20 each have a plurality of fluid dispensing nozzles 50 mounted thereon for releasing a source of a fluid (typically air) which is employed, at least in part, to combust a product 13. Following the combustion of the product 13, a non-combustible waste product 14 is left behind. In the present invention 10, particulate matter 12 is supported, at least in part, on, and above, the fluidizing manifolds 20 and which is sized to pass between the respective fluidizing manifolds 20. During the combustion of the product 13 the resulting waste product 14 becomes mixed with the particulate matter 12, and passes between the respective fluidizing manifolds 20 under the influence of gravity. In the arrangement as seen in the drawings, a frustum-shaped enclosure 60 is provided, and is defined by four sidewalls 71-74, and which is positioned in gravity receiving relation relative to the multiplicity of fluidizing manifolds 20. The enclosure 60 receives the particulate matter 12, and the non-combustible waste material 14 which passes between the multiplicity of fluidizing manifolds 20. The four sidewalls 71-74 of the enclosure define an internal cavity 70 which has a first intake end 61 which has a first internal cross sectional dimension, and a second, discharge end 62 which defines a discharge aperture 63 which has a substantially rectangular shape and a cross sectional dimension which is less than the cross sectional dimension of the internal cavity 70 as measured at the first intake end 61. In the arrangement as seen in the drawings, at least two of the four sidewalls, that being 71 and 72 of the enclosure 60 are substantially vertically oriented. The enclosure may further include a cooling means which is incorporated or made integral with the enclosure and which is effective to reduce the temperature of the particulate matter and any non-combustible waste material as it moves from the first intake end 61 to the discharge end 62 thereof. This cooling means in one possible form or embodiment may include the positioning of an air manifold (not shown) below the fluidizing manifolds 20, as illustrated. Such means may also include water jackets and other similar devices which operate as heat sinks to effectively dissipate heat from the particulate matter 12. For purposes of this application, these possible structures are not shown so as to enable one to see and understand the other salient features of the invention. A selectively rotatable engagement assembly 80 is provided, and is mounted within the internal cavity 70, and located between the first intake end 61 of the enclosure 60, and the second discharge end 62 thereof. The rotation of the engagement assembly 80 has the effect of moving, at least in part, the particulate matter 12, and any non-combustible waste material 14 substantially laterally, and generally horizontally, so as to facilitate the substantial uniform, vertical movement of the particulate matter 12, and the non-combustible waste material 14 from the first intake end 61, to the second discharge end 62 of the enclosure 60. The invention 10 further includes a moveable clam-shell shaped gate arrangement 120 which is mounted on the second discharge end 62 of the enclosure 60, and which is further operable to selectively occlude the discharge aperture 63. The moveable clam-shell shaped gate 120 facilitates the removal of the particulate matter 12, and any entrained waste material 14 from the enclosure 60, by way of the discharge aperture 63 under the influence of gravity, when the clam-shell shaped gate is located in a non-occluding orientation relative to the discharge aperture 63.

More specifically, the present invention relates to a fluidized bed 10 which includes a multiplicity of fluidizing manifolds 20 each having an elongated main body 21 having opposite first and second ends 22 and 23, respectively, and top and bottom surfaces 24 and 25, respectively. The top surface 24 comprises a pair of angulated surfaces 30 which converge at an apex 33. These angulated surfaces 30 facilitate the effective removal of the particulate matter 12, and any waste products 14 when these are removed or otherwise drained from enclosure 60. A primary fluid passageway 34 extends from the first end 22 of the elongated main body 21 in the direction of the second end 23. The primary fluid passageway 34 of the fluidizing manifold main body 21 distributes a substantially uniform volume of air or other pressurized gaseous fluid to each of the nozzles 50 which are attached to the apex 33 of the top surface 24 of the elongated main body 21. Individual fluid dispensing nozzles 50 are provided, and mounted on the apex 23 of the top surface 24 of the elongated main body 21, and positioned in fluid receiving relation relative to the primary fluid passageways 34. The respective fluid dispensing nozzles 50 each have multiple fluid releasing apertures 53 formed in a given pattern therein. At least some of the fluid releasing apertures 53 direct a stream of fluid substantially, laterally, outwardly relative to the pair of angulated surfaces 30 which form the top surface 24 of the elongated main body 21. Particulate matter 12 is supported, at least in part, on, and above, the fluidizing manifolds 20, and which is sized to pass between the respective fluidizing manifolds 20. During a combustion and/or gasification of a product 13 in the presence of the particulate matter 12, a resulting non-combustible waste product 14 is produced and subsequently becomes mixed or entrained within the particulate matter 12, and passes between the respective fluidizing manifolds 20 under the influence of gravity. A frustum-shaped enclosure 60 is provided, and is defined by four sidewalls 71-74, and which is positioned in gravity receiving relation relative to the multiplicity of fluidizing manifolds 20. The enclosure 60 receives the particulate matter 12, and the non-combustible waste material 14 which passes between the multiplicity of fluidizing manifolds 20. The four sidewalls 71-74 of the enclosure 60 define an internal cavity 70. The enclosure 60 further has a first intake end 61, which has a first internal cross sectional dimension, and a second, discharge end 62, which defines a discharge aperture 63 which has a rectangular shape, and a cross sectional dimension which is less than about 15% that of the cross sectional dimension of the internal cavity 70 as measured at the first intake end 31. At least two of the four sidewalls 71 and 72 of the enclosure 60 are substantially vertically oriented. In the arrangement as seen in the drawings, a selectively operable motor 90 is mounted on the enclosure 60. Further, an elongated rotatable shaft 100 is located within the enclosure 60 and which is substantially horizontally oriented relative thereto, and which is drivingly coupled to the motor 90. A multiplicity of engagement members 104 are mounted on and extend substantially radially, outwardly, from the elongated shaft 100, and which forcibly engage and drive at least some of the particulate matter 12, and any non-combustible waste material 14 passing thereby substantially laterally, outwardly so as to facilitate the substantially uniform vertical movement of the particulate matter 12, and the non-combustible waste material 14 from the first intake end 61 to the second discharge end 62 of the enclosure 60. A selectively moveable and generally clam-shell shaped gate arrangement or assembly 122 is provided, and which substantially selectively sealably occludes the discharge aperture 63 defined by the second discharge end 62 of the enclosure 60. The gate 122 is selectively moveable from a first occluding position relative to the discharge aperture 63, to a second, displaced and non-occluding position relative to the discharge aperture 63. The moveable gate 122, in the second position facilitates the removal of the particulate matter 12 and any non-combustible waste material 14 under the influence of gravity from the enclosure 60.

As earlier disclosed, the selectively movable gate assembly 120 includes both a first clam-shell shaped gate 121 and a second multiple-part clam-shell shaped gate 122. In the arrangement as seen in the drawings, the second clam-shell shaped gate is formed of three portions 151, 152 and 153, respectively which can be independently moved either into an occluding or non-occluding orientation relative to the discharge aperture 63 so as to facilitate the selective removal of particulate matter 12 and any entrained waste product 14 from the internal cavity 70 in a manner which facilitates the continuous operation of the fluidizing bed 10 in a manner not possible heretofore.

Therefore, it will be seen that the present fluidized bed provides many advantages over the prior art devices employed heretofore, and allows an operator to continuously use the fluidized bed to combust various products, but simultaneously allows the removal of non-combustible waste products while maintaining the operation of the fluidized bed.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A fluidized bed, comprising:

a multiplicity of fluidizing manifolds disposed in predetermined spaced relationship one to the others;

particulate matter supported on, and above, the fluidized manifolds and which is further sized to pass between the respective fluidizing manifolds, and wherein during the operation of the fluidized bed a product is combusted in the presence of the particulate matter so as to produce, at least in part, a non-combustible waste material which becomes mixed with the particulate matter;

an enclosure having a first intake end located in gravity receiving relationship relative to the multiplicity of fluidizing manifolds, and a second discharge end defining a discharge aperture, and wherein the first intake end of the enclosure receives the particulate matter and any non-combustible waste material which passes between the respective fluidizing manifolds following the combustion of the product which produces the non-combustible waste material;

a moveable gate assembly mounted on the second discharge end of the enclosure, and operable for selectively occluding the discharge aperture and wherein the gate assembly includes a first gate, and a second multiple portion gate, and wherein the respective portions of the second multiple portion gate are individually, selectively moveable one relative to the others, and wherein the first, and second multiple portion gates are alternately, individually moveable so as to be located in occluding relation relative to the discharge aperture of the enclosure, and wherein the second, multiple portion gate, when located in an occluding position relative to the discharge aperture, is operable to move selective portions of the second, multiple portion gate to a non-occluding position relative to the discharge aperture so as to allow particulate matter, and any non-combustible waste material to be gravitationally drained, and removed from the enclosure by passing through the discharge aperture; and a selectively rotatable engagement assembly mounted within the enclosure and located between the first intake end and the second discharge end thereof, and wherein the selective rotation of the engagement assembly facilitates the substantially uniform movement of the particulate matter and the non-combustible waste material, under the influence of gravity, from the first intake end of the enclosure to the second discharge end thereof.

2. A fluidized bed as claimed in claim 1, and wherein the respective fluidizing manifolds further comprise:

an elongated main body having opposite first and second ends, and top and bottom surfaces, and wherein the top surface comprises a pair of angulated surfaces which converge at an apex, and wherein a primary fluid passageway extends from the first end of the elongated main body in the direction of the second end; and individual fluid dispensing nozzles mounted on the apex of the top surface of the elongated main body and positioned in fluid receiving relation relative to the primary fluid passageway.

3. A fluidized bed as claimed in claim 2, and wherein the respective fluid dispensing nozzles each have multiple fluid releasing apertures formed therein, and wherein at least some of the fluid releasing apertures direct a stream of fluid laterally outwardly relative to the pair of angulated surfaces which form the top surface of the elongated main body.

4. A fluidized bed as claimed in claim 1, and wherein the first moveable gate comprises a selectively moveable and generally clam-shell shaped gate which substantially selectively sealably occludes the discharge aperture which is defined by the second discharge end of the enclosure, and wherein the first gate is selectively moveable from a first occluding position relative to the discharge aperture, to a second, displaced, and non-occluding position relative to the discharge aperture while the second, multiple portion gate moves from a non-occluding position relative to the discharge aperture to an occluding position, and wherein the second multiple portion gate, when located in the occluding position relative to the discharge aperture, facilitates the removal of the particulate matter and any non-combustible waste material under the influence of gravity from the enclosure when one of the portions of the second, multiple portion gate is selectively moved to a non-occluding position relative to the discharge aperture.

5. A fluidized bed as claimed in claim 4, and further comprising a multiplicity of selectively operable actuators mounted on the enclosure and drivingly coupled to the first and second gates and which, when rendered operational are effective in moving the respective first and second gates between the occluding position, and the non-occluding position relative to the discharge aperture.

6. A fluidized bed as claimed in claim 1, and wherein the selectively rotatable engagement assembly further comprises:

a selectively operable motor mounted on the enclosure; and an elongated rotatable shaft located within the enclosure and horizontally oriented relative thereto, and wherein the rotatable shaft is drivingly coupled to the motor, and wherein a multiplicity of engagement members are mounted on and extend substantially radially, outwardly, from the elongated shaft, and which forcibly engage the particulate matter and any non-combustible waste material passing thereby and drive them, at least in part, substantially horizontally so as to facilitate the substantially uniform movement of the particulate matter and the non-combustible waste material in a substantially vertical direction from the first intake end to the second, discharge end of the enclosure.

7. A fluidized bed as claimed in claim 1, and wherein the enclosure has a frustum-like shape which has four side walls, and which further defines an internal cavity, and wherein the four sidewalls include a first pair of oppositely disposed sidewalls which are substantially vertically oriented, and a second pair of sidewalls which are non-vertically oriented, and which converge, one towards the other, at the second discharge end of the enclosure, and wherein the internal cavity has a diminishing cross-sectional dimension when measured in a direction which extends from the first intake end of the enclosure to the second discharge end thereof.

8. A fluidized bed as claimed in claim 7, and wherein the discharge aperture is substantially rectangular shaped, and further has a cross-sectional dimension which is less than about 15% of the cross-sectional dimension of the internal cavity when that same cross sectional dimension is measured at the first intake end of the enclosure.

9. A fluidized bed as claim 1, and further comprising cooling means borne by the enclosure for reducing the temperature of the particulate matter and any non-combustible waste material moving from the first intake end of the enclosure to the second discharge end thereof.

10. A fluidized bed, comprising:

a multiplicity of fluidizing manifolds positioned in a substantially horizontal orientation and in predetermined spaced relation one relative to the others, and wherein the respective fluidizing manifolds each have a plurality of fluid dispensing nozzles mounted thereon for releasing a source of a fluid which is used, at least in part, to combust a product, and wherein following the combustion of the product, a non-combustible waste material is left behind;

particulate matter supported on, and above, the fluidizing manifolds and which is sized to pass between the respective fluidizing manifolds, and wherein during the combustion of the product the resulting waste material becomes mixed with the particulate matter and passes between the respective fluidizing manifolds under the influence of gravity;

a frustum-shaped enclosure defined by four sidewalls and which is positioned in gravity receiving relation relative to the multiplicity of fluidizing manifolds, and wherein the enclosure receives the particulate matter and the non-combustible waste material which passes between the multiplicity of fluidizing manifolds, and wherein the four sidewalls of the enclosure define an internal cavity which has a first intake end, and which further has a first internal cross sectional dimension, and a second, discharge end which defines a discharge aperture which has a substantially rectangular shape and a cross sectional dimension which is less than the cross sectional dimension of the internal cavity as measured at the first intake end, and wherein at least two of the four sidewalls of the enclosure are substantially vertically oriented;

a selectively rotatable engagement assembly mounted within the internal cavity, and located between the first intake end of the enclosure, and the second discharge end thereof, and wherein the rotation of the engagement assembly has the effect of moving, at least in part, the particulate matter and any non-combustible waste material substantially laterally so as to facilitate the substantially uniform, vertical movement of the particulate matter, and the non-combustible waste material from the first intake end, to the second discharge end of the enclosure; and a first moveable clam-shell shaped gate mounted on the second discharge end of the enclosure and which is operable to selectively occlude the discharge aperture, and a second, selectively operable, multiple portion, clam shell shaped gate, and which is operable to move from a non-occluding position relative to the discharge aperture, to an occluding position relative thereto when the first clam shell shaped gate moves from the occluding position relative to the discharge aperture to a non-occluding relation relative thereto, and wherein the second, moveable multiple portion, clam-shell shaped gate facilitates the removal of the particulate matter, and any entrained waste material from the enclosure, by way of the discharge aperture, when selective portions of the second, multiple portion clam-shell shaped gate are located in a non-occluding orientation relative to the discharge aperture.

11. A fluidized bed as claimed in claim 10, and wherein the respective fluidizing manifolds further comprise:

an elongated main body having opposite first and second ends, and top and bottom surfaces, and wherein the top surface comprises a pair of angulated surfaces which converge at an apex, and wherein a primary fluid passageway extends from the first end of the elongated main body in the direction of the second end, and wherein the respective fluid dispensing nozzles are mounted on the apex of the top surface of the elongated main body and are individually positioned in fluid receiving relation relative to the respective primary fluid passageway.

12. A fluidized bed as claimed in claim 11, and wherein the respective fluid dispensing nozzles each have multiple fluid releasing apertures formed therein, and at least some of the fluid releasing apertures direct a stream of fluid laterally, outwardly relative to the pair of angulated surfaces which form the top surface of the elongated main body.

13. A fluidized bed as claimed in claim 12, and further comprising a multiplicity of selectively operable actuators mounted on the enclosure and drivingly coupled to the first and second gates and which, when rendered operational, are effective in moving the generally first and second gates between their respective, occluding position, and non-occluding position, relative to the discharge aperture.

14. A fluidized bed as claimed in claim 10, and wherein the selectively rotatable engagement assembly further comprises:

a selectively operable motor mounted on the enclosure; and an elongated rotatable shaft located within the enclosure and horizontally oriented relative thereto, and wherein the rotatable shaft is drivingly coupled to the motor, and wherein a multiplicity of engagement members are mounted on and extend substantially radially, outwardly, from the elongated shaft, and which forcibly engage and drives the particulate matter and any non-combustible waste material passing thereby, at least in part, substantially laterally, so as to facilitate the substantially uniform vertical movement of the particulate matter and the non-combustible waste material from the first intake end to the second discharge end of the enclosure.

15. A fluidized bed as claimed in claim 10, and further comprising cooling means borne by the enclosure and which reduces the temperature of the particulate matter, and any non-combustible waste material moving from the first intake end of the enclosure to the second discharge end thereof.

16. A fluidized bed, comprising:

a multiplicity of fluidizing manifolds each having an elongated main body having opposite first and second ends, and top and bottom surfaces, and wherein the top surface comprises a pair of angulated surfaces which converge at an apex, and wherein a primary fluid passageway extends from the first end of the elongated main body in the direction of the second end, and the apex of the top surface of the elongated main body;

individual fluid dispensing nozzles mounted on the apex of the top surface of the elongated main body and positioned in fluid receiving relation relative to the primary fluid passageway, and wherein the respective fluid dispensing nozzles each have multiple fluid releasing apertures formed therein, and wherein at least some of the fluid releasing apertures direct a stream of fluid laterally outwardly relative to the pair of angulated surfaces which form the top surface of the elongated main body;

particulate matter supported on, and above the fluidizing manifolds, and which is sized to pass between the respective fluidizing manifolds, and wherein during a combustion of a product in the presence of the particulate matter a resulting non-combustible waste product is produced and subsequently becomes mixed within the particulate matter and passes between the respective fluidizing manifolds under the influence of gravity;

a frustum-shaped enclosure defined by four sidewalls and which is positioned in gravity receiving relation relative to the multiplicity of fluidizing manifolds, and wherein the enclosure receives the particulate matter and the non-combustible waste material which passes between the multiplicity of fluidizing manifolds, and wherein the four sidewalls of the enclosure define an internal cavity, and further has a first intake end which has a first internal cross sectional dimension, and a second, discharge end which defines a discharge aperture which has a rectangular shape and a cross sectional dimension which is less than the cross sectional dimension of the internal cavity as measured at the first intake end, and wherein at least two of the four sidewalls of the enclosure are substantially vertically oriented;

a selectively operable motor mounted on the enclosure;

an elongated rotatable shaft located within the enclosure and which is substantially horizontally oriented relative thereto, and wherein the rotatable shaft is drivingly coupled to the motor, and wherein a multiplicity of engagement members are mounted on and extend substantially radially, outwardly, from the elongated shaft, and which forcibly engage and drive at least some of the particulate matter and any non-combustible waste material passing thereby substantially laterally so as to facilitate the substantially uniform vertical movement of the particulate matter and the non-combustible waste material from the first intake end to the second discharge end of the enclosure; and a first selectively moveable and generally clam-shell shaped gate which is borne by the enclosure, and which substantially selectively sealably occludes the discharge aperture defined by the second discharge end of the enclosure, and wherein the first gate is selectively moveable from a first occluding position relative to the discharge aperture, to a second, displaced and non-occluding position relative to the discharge aperture; a second moveable, and selectively operable multiple part gate which is borne by the enclosure, and which is moveable between a non-occluding position relative to the discharge aperture, to an occluding position relative to the discharge aperture as the first gate moves from the first occluding position relative to the discharge aperture to the second, non-occluding position relative thereto, and wherein the second moveable multiple portion gate, in the occluding position relative to the discharge aperture facilitates the removal of the particulate matter and any non-combustible waste material under the influence of gravity from the enclosure when selective portions of the second multiple portion gate are moved to a non-occluding position relative to the discharge aperture.

17. A fluidized bed as claim 16, and further comprising cooling means borne by the enclosure for reducing the temperature of the particulate matter and any non-combustible waste material moving from the first intake end of the enclosure to the second discharge end thereof.

18. A fluidized bed, comprising:

a multiplicity of fluidizing manifolds each having an elongated main body having opposite first and second ends, and top and bottom surfaces, and wherein the top surface comprises a pair of converging, angulated surfaces, and which intersect at an apex, and wherein the elongated main body of each fluidizing manifold is located in predetermined, spaced relation relative to an adjacent fluidizing manifold so as to define a substantially uniformly dimensioned passageway therebetween, and wherein a primary fluid passageway extends from the first end of the elongated main body in the direction of the second end, and to the apex of the top surface of the elongated main body;

individual fluid dispensing nozzles mounted on the apex of the top surface of the elongated main body of the respective fluidizing manifolds, and which are further positioned in fluid receiving relation relative to the primary fluid passageway, and wherein the respective fluid dispensing nozzles each have multiple fluid releasing apertures formed therein, and wherein at least some of the fluid releasing apertures direct a stream of fluid laterally, outwardly, relative to the pair of angulated surfaces, and which are located below the individual dispensing nozzles, and which further form the top surface of the elongated main body of the respective fluidizing manifolds;

particulate matter supported on, and above, the respective fluidizing manifolds, and which is further sized to pass between the respective fluidizing manifolds, and wherein during a subsequent combustion of a product in the presence of the particulate matter a resulting non-combustible waste product is produced and subsequently becomes entrained with the particulate matter, and then passes, under the influence of gravity, through the respective substantially uniformly dimensioned passageways which are defined between the respective fluidizing manifolds, and wherein the combustion of the product produces a resulting combustion heat which is substantially confined to the fluidized bed;

a frustum-shaped enclosure defined by four sidewalls, and which is positioned in non-combustible waste product receiving relationship relative to the multiplicity of fluidizing manifolds, and wherein the four sidewalls of the enclosure define an internal cavity which has a first intake end which has a first cross sectional dimension, and a second, discharge end which defines a substantially rectangularly shaped discharge aperture, and wherein the discharge aperture has a cross sectional dimension which is less than cross sectional dimension of the first, intake end, and wherein at least two of the four sidewalls of the frustum-shaped enclosure are vertically oriented, and are positioned opposite, one relative to the other;

a selectively operable motor mounted on at least one of the four sidewalls of the frustum-shaped enclosure;

an elongated rotatable shaft located within the internal cavity of the enclosure, and which is substantially horizontally oriented relative thereto, and wherein the rotatable shaft is drivingly coupled to the motor, and wherein a multiplicity of engagement members are mounted on, and extend substantially radially, outwardly from the elongated shaft, and which forcibly engage and direct at least some of the particulate matter, and any non-combustible waste product passing gravitationally downwardly through the frustum-shaped enclosure to move substantially laterally so as facilitate the substantially uniform vertical movement of the particulate matter, and the entrained non-combustible waste product from the first intake end of the enclosure to the second end, thereof; and a selectively moveable gate assembly which substantially, selectively, and sealably occludes the discharge aperture which is defined by the second end of the frustum-shaped enclosure, and wherein the gate assembly includes a first, clam shell shaped gate, and a second, multiple portion, clam shell shaped gate, and wherein the respective portions of the second gate are individually selectively moveable, one relative to the other portions, and wherein the respective first, and the second, multiple portion gates are alternatively, individually, moveable so as to be located in substantially sealably occluding relation relative to the discharge aperture of the enclosure, and wherein the first gate is simultaneously moveable from a non-occluding position to an occluding position relative to the discharge aperture when the second, multiple portion gate moves from an occluding position to a non occluding position relative to the discharge aperture, and wherein the first gate, when located in the occluding position relative to the discharge aperture, permits the second, multiple portion gate, which is located in a non-occluding position to be inspected, and maintained as required, and wherein the first gate is further simultaneously moveable from the occluding position relative to the discharge aperture which is defined by the enclosure, to a non-occluding position relative to the discharge aperture when the second, multiple portion gate moves from a non-occluding position relative to the discharge aperture, to an occluding position relative thereto, and wherein the second, multiple portion gate, when located in the occluding position relative to the discharge aperture is operable to move selective portions of the second gate in a cooperative and coordinated movement from an occluding, to a non-occluding position relative to the discharge aperture of the enclosure so as to allow the particulate matter, and any entrained, non-combustible waste product, to be effectively, gravitationally drained, and removed, from the internal cavity of the frustum-shaped enclosure, by passing through the discharge aperture of the frustum-shaped enclosure under the influence of gravity while simultaneously preserving, to the extent possible, the heat of combustion within the fluidized bed.

* * * * *